US007367157B1

(12) United States Patent
Doan

(10) Patent No.: US 7,367,157 B1
(45) Date of Patent: May 6, 2008

(54) WATER EASE FOR CHRISTMAS TREES

(76) Inventor: Bruce C. Doan, 8607 Driftwood Dr., Tampa, FL (US) 33615

( * ) Notice: Subject to any disclaimer, the term of this patent is extended or adjusted under 35 U.S.C. 154(b) by 808 days.

(21) Appl. No.: 10/728,430

(22) Filed: Dec. 8, 2003

(51) Int. Cl.
*A47G 33/12* (2006.01)

(52) U.S. Cl. ..... 47/40.5; 47/48.5; 119/51.03; 119/51.5; 119/72

(58) Field of Classification Search ..... 47/40.5, 47/48.5; 119/51.03, 51.5, 72
See application file for complete search history.

(56) References Cited

U.S. PATENT DOCUMENTS 2,938,304 A 5/1960 Thomas et al.
3,469,342 A 9/1969 Morris
4,993,176 A 2/1991 Spinosa
5,009,028 A * 4/1991 Lorenzana et al. ..... 47/40.5
5,076,009 A 12/1991 Cibor
5,157,868 A 10/1992 Munoz
D378,266 S * 3/1997 Buehler ..... D8/1
5,857,484 A * 1/1999 Davidian ..... 137/454
6,439,521 B1 * 8/2002 Wilson et al. ..... 248/227.3

* cited by examiner

*Primary Examiner*—Michael J. Carone
*Assistant Examiner*—Willie Berry, Jr.

(57) ABSTRACT

An apparatus for watering Christmas trees includes a bottle defining a reservoir and having an opening for allowing fluid to travel outwardly through an elongated flexible hose attached thereto. The apparatus further includes an elongated rigid tube engageable with the hose and a basin housing a tree. The apparatus further includes a stand for supporting the bottle thereon and at an inverted position. The stand includes a top member having a substantially annular portion for receiving the bottle therein and for allowing the tube to be selectively positioned therethrough. The stand further includes a plurality of fastening members for selectively engaging the top member and the base member with each other.

12 Claims, 4 Drawing Sheets

WATER EASE FOR CHRISTMAS TREES

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to plant watering apparatuses and, more particularly, to a water ease for Christmas trees.

2. Prior Art

The problem of keeping Christmas trees fresh while in a stand in an interior environment has long been known. Most stands are designed to hold a very limited supply of water with a consequence that refills are frequently necessary. Since most natural trees used for indoor purposes have relatively sharp needles, pouring water into the base of the stand is decidedly awkward and tends to become a chore that is easily neglected given its location at the bottom and center of the tree. Given the rapid absorption of water by most trees in the dry environment of a heated interior space, this inconvenience is significant. The end result is that the tree dries out and begins to shed its needles, creating a fire hazard.

Another problem with many stands is that they are unstable when in use so that the tree is easily upset with consequent damage to the tree and possible spillage of the water from the stand itself. This is particularly true with taller, heavier trees because most stands are manufactured to fit the most common size Christmas trees and cannot support tall trees adequately.

Heretofore, attempts have been made to maintain Christmas trees by providing separate water reservoirs connected to the base by a length of tubing. For example, the design shown in U.S. Pat. No. 3,469,342 discloses a reservoir disposed at floor level. This design creates an obstacle to foot traffic and still requires bending over to check and fill the reservoir.

U.S. Pat. No. 5,076,009 also discloses a Santa Claus shaped reservoir watering system that can be placed on a table or other elevated surface to eliminate the foot traffic obstacle and bending noted above. U.S. Pat. No. 5,076,009 also discloses a float assembly disposed in the basin of the stand of the Christmas tree for maintaining the water level at a selected level. While this method appears to solve the problem of conveniently maintaining the level of water in the basin, it is well known in the industry that such floats are invariably susceptible to penetration and/or absorption of fluids, rendering them ineffective and in need of being replaced. In addition, the reservoir is shaped and decorated to resemble a Santa Claus, making it difficult to ascertain the water level within the reservoir. The end result is a reservoir that will likely empty before a user realizes it needs to be refilled.

There has also heretofore been offered for sale a tree hung ornament adapted to receive water and direct the same to the base via a float controlled valve. The disadvantage to that approach is the limitation on the quantity of water able to be held in the ornament, since only a relatively light weight is able to be borne by the branches of the tree. Thus, frequent attention to filling with water is required. The tree mounted location also raises the possibility that the reservoir will fall, spilling water to create an electrical shock hazard, and also involves a two handed procedure.

Accordingly, it is an object of the present invention to provide a tree watering apparatus adapted to conveniently allow maintenance of a water supply in the tree base without frequent attention to this chore. It is another object to provide such a device which is convenient to install and reliable in operation, with a minimum possibility of flooding or accidental spillage and breakage.

Accordingly, a need remains for an easy to maintain, easy to install, Christmas tree watering system that minimizes safety hazards such as foot obstacles and water spillage.

BRIEF SUMMARY OF THE INVENTION

In view of the foregoing background, it is therefore an object of the present invention to provide an apparatus for watering Christmas trees after they have been cut and placed in a tree stand. These and other objects, features, and advantages of the invention are provided by a Christmas tree water feeder including a bottle defining a reservoir and having an opening for allowing fluid to travel outwardly from the reservoir.

The water feeder further includes an elongated flexible hose defining a conduit and having a first end portion removably insertable into the opening. The bottle includes a cap having a threaded inner surface for engaging the opening of the bottle and the hose has an oppositely spaced second end portion extending outwardly and away from the bottle. The hose further includes a rubber seal positioned adjacent to the opening and the first end portion of the hose for assisting to prevent water from leaking out of the opening. The cap has an aperture formed substantially centrally thereof and is in fluid communication with the flexible hose.

The apparatus further includes an elongated rigid tube having a longitudinal axis and opposed end portions engageable with the second end portion of the hose and a basin housing a plant. One of the opposed end portions of the tube has an arcuate shape and extends in a substantially orthogonal direction to the axis for directing water to the basin.

The apparatus further includes a stand for supporting the bottle thereon and at an inverted position. The stand includes a top member and a base member adjustably engageable therewith and for allowing a height between the opening of the bottle and a ground surface to be selectively adjusted. The top member includes a substantially annular portion integral therewith and for receiving the bottle thereon. The annular portion has an opening spaced above the base member and for allowing the tube to be selectively positioned therethrough.

The stand further includes a plurality of fastening members for selectively engaging the top member and the base member with each other. The top base member has a plurality of oppositely spaced slots extending substantially vertically therealong and the plurality of fastening members are adjustably positionable along the plurality of slots to thereby adjust a height of the stand.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
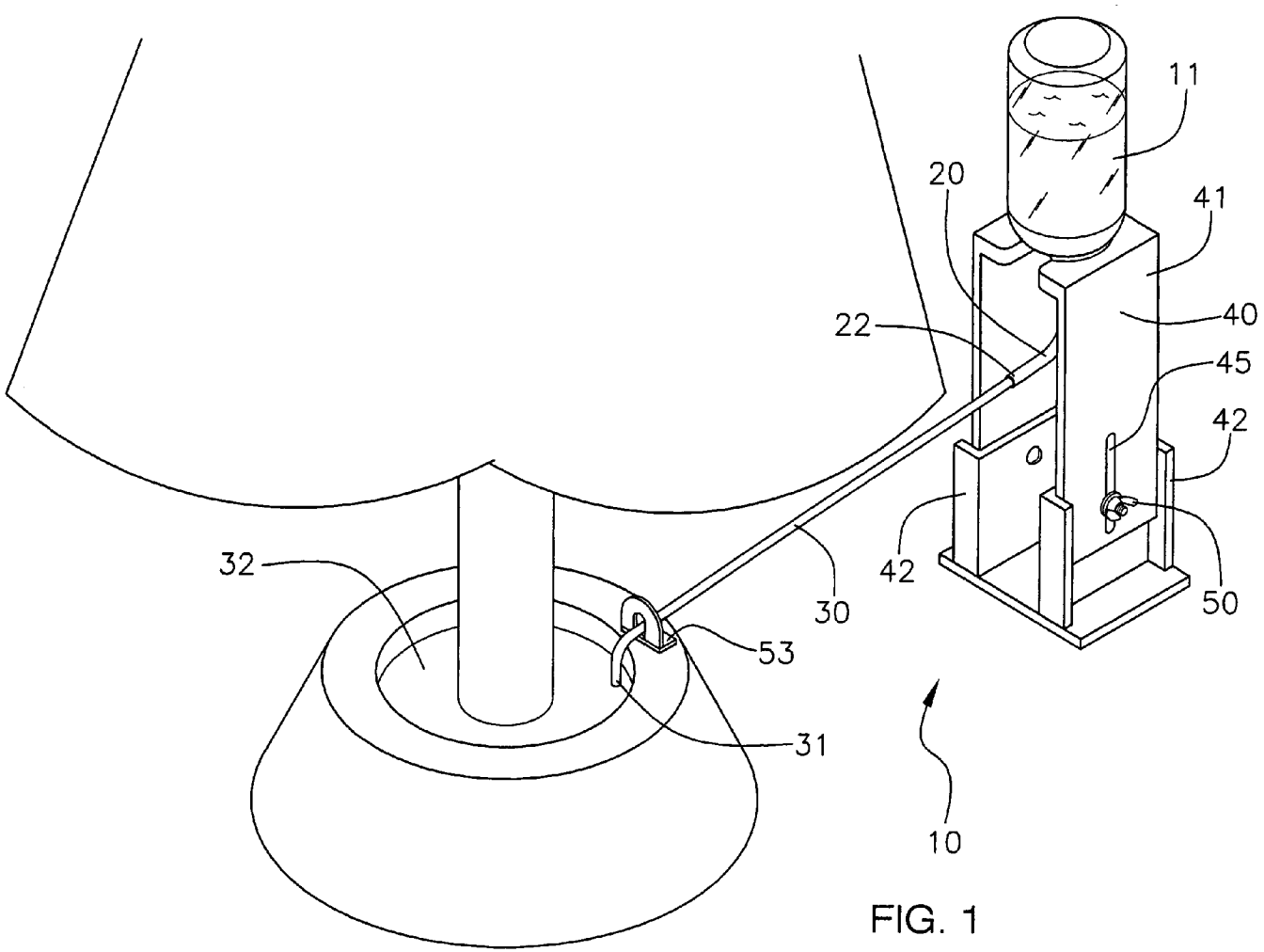
FIG. 1 is a perspective view showing a Christmas tree water feeder in a preferred environment, in accordance with the present invention.
Figure 2:
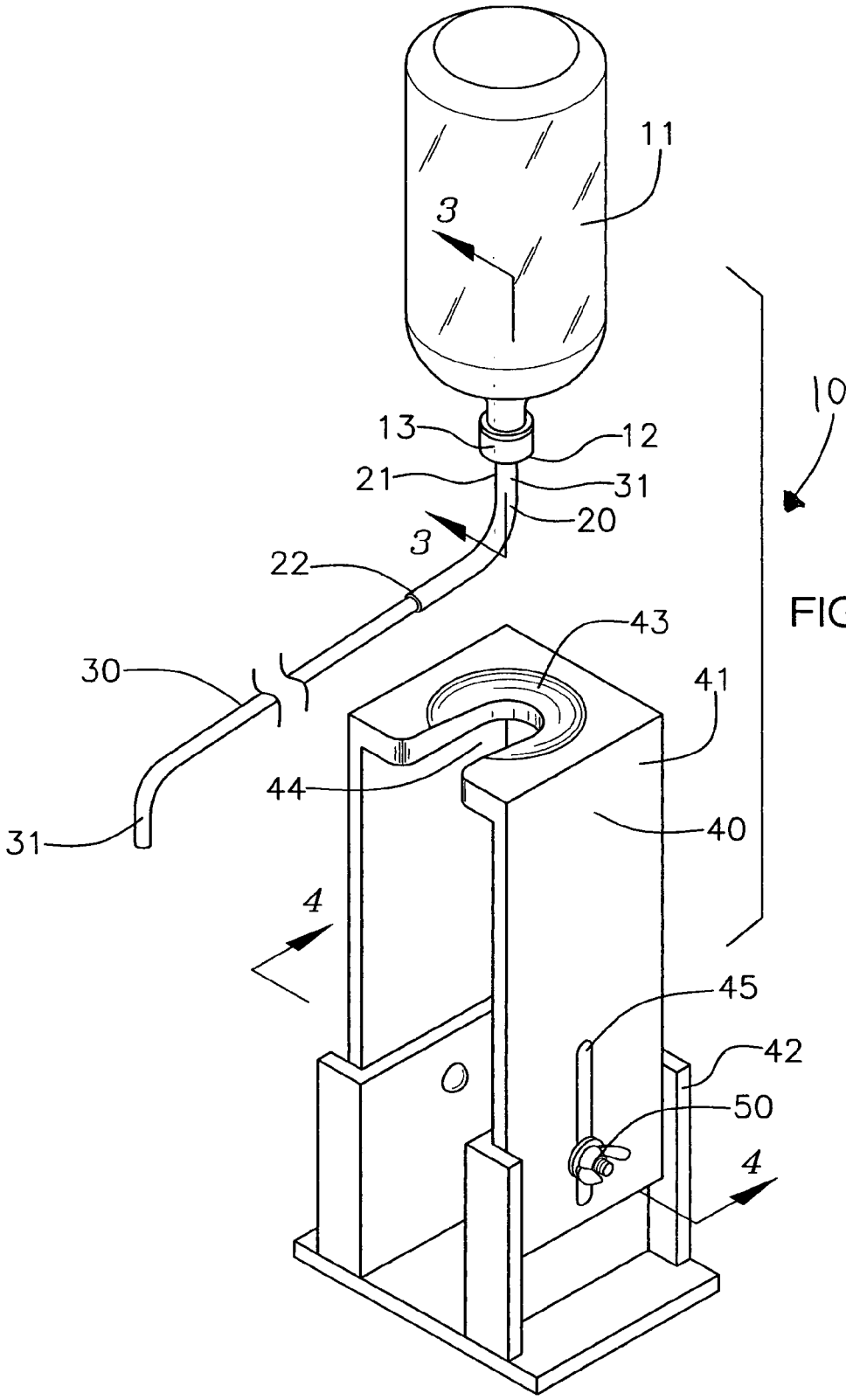
FIG. 2 is an enlarged perspective view of the apparatus shown in FIG. 1.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art.

The apparatus of this invention is referred to generally in FIGS. 1-4 by the reference numeral 10 and is intended to provide an apparatus for selectively watering Christmas trees. It should be understood that the apparatus 10 may be used to water many different types of plants or trees and should not be limited to watering only Christmas trees. Initially referring to FIG. 2, the apparatus 10 includes a bottle 11 defining a reservoir and having an opening 12 for allowing fluid to travel outwardly from the bottle 11. An elongated flexible hose 20 defines a conduit and has a first end portion 21 removably insertable into the opening 12.

Figure 3:
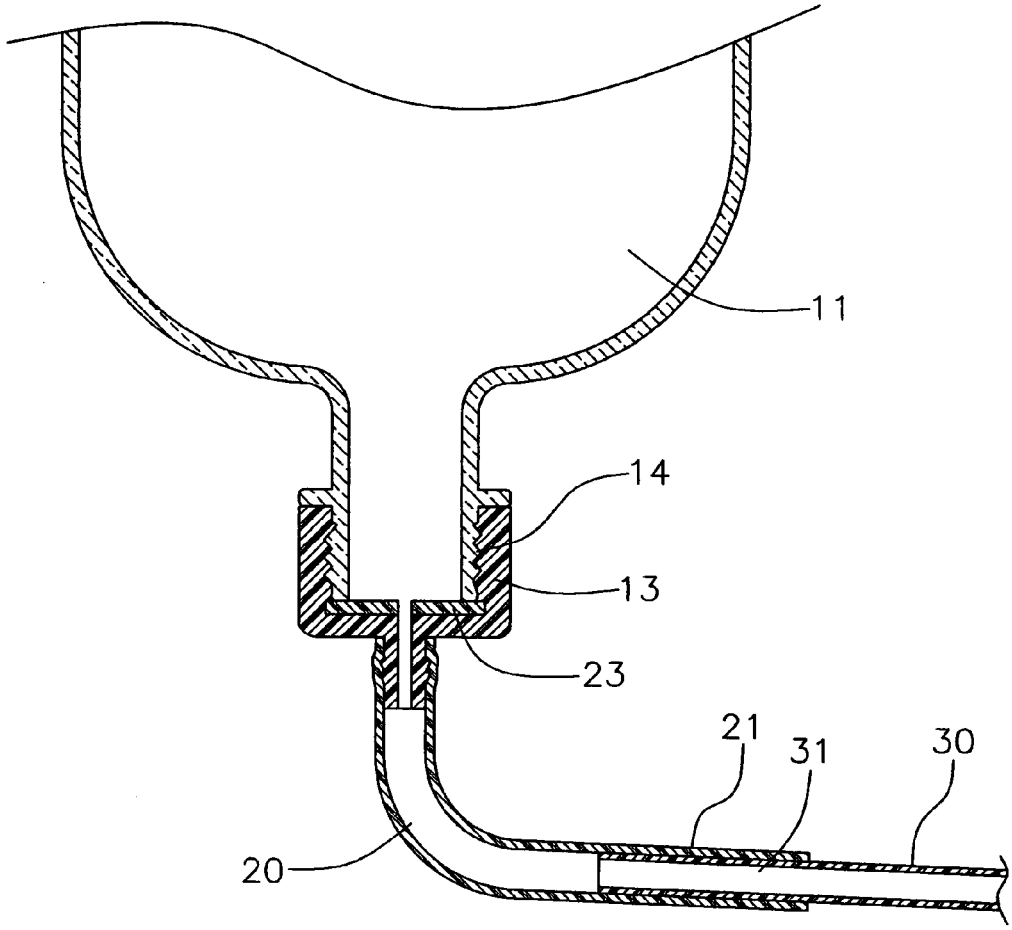
FIG. 3 is an enlarged cross-sectional view of the bottle and hose shown in FIG. 1, taken along line 3-3.

The bottle 11 includes a cap 13 having a threaded inner surface 14 for engaging the opening 12, as perhaps best shown in FIG. 3. The bottle 11 is preferably formed of transparent plastic so that the water level could be readily ascertained and a user would know at a glance when water needs to be added. The hose 20 has an oppositely spaced second end portion 22 extending outwardly and away from the bottle 11. The hose 20 further includes a rubber seal 23 positioned within the opening 12 and about the first end portion 21 of the hose 20 and for assisting to prevent water from leaking out of the opening 12. The cap 13 has an aperture formed substantially centrally thereof and is in fluid communication with the flexible hose 20.

Now referring to FIG. 1, the apparatus 10 further includes an elongated rigid tube 30 having a longitudinal axis (not shown) and opposed end portions 31 engageable with the second end portion 22 of the hose 20 and a basin 32 housing a plant. One of the opposed end portions 31 of the tube 30 has an arcuate shape and extends in a substantially orthogonal direction to the axis. Advantageously, the flexible hose 20 allows a user to position the tube 30 at varying angles so that the apparatus 10 can be positioned in the most convenient place. As the tree uses the water, the water level becomes lowered, allowing air into the tube 30 and bottle 11. The air displaces the water in the bottle 11 and raises the water level in the basin 32 to the point where air could not enter the tube 30, thereby stopping the flow of water to the basin 32.

Now referring back to FIG. 2, the apparatus 10 further includes a stand 40 for supporting the bottle 11 thereon, at an inverted position. The stand 40 includes a top member 41 and a base member 42 adjustably engageable therewith and for allowing a height between the opening 12 of the bottle 11 and a ground surface to be selectively adjusted. The top member 41 includes a substantially annular portion 43 integral therewith and for receiving the bottle 11 thereon. The annular portion 43 has an opening 44 spaced above the base member 42 and for allowing the tube 30 to be selectively positioned therethrough.

Figure 4:
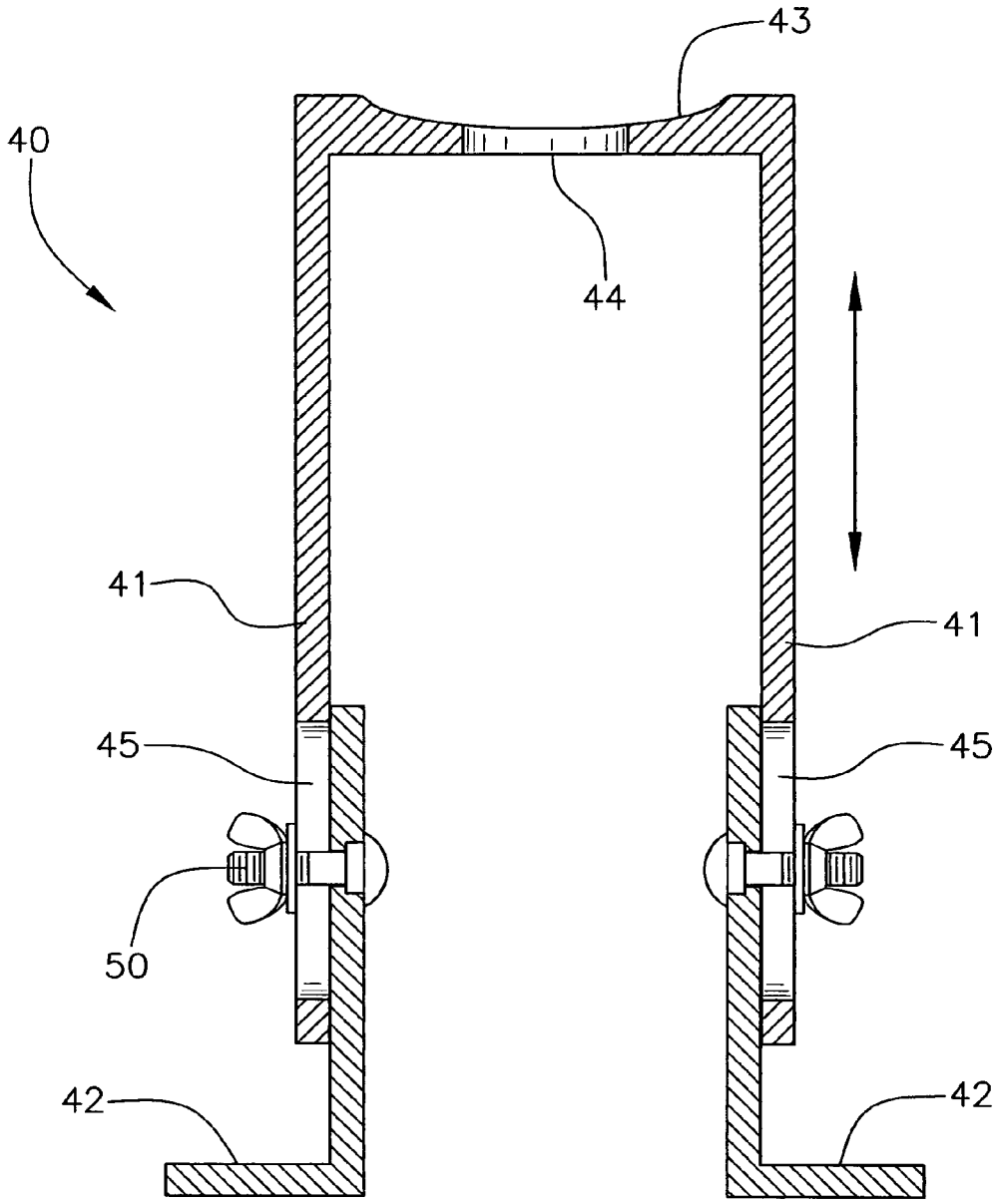
FIG. 4 is an enlarged cross-sectional view of the stand shown in FIG. 1, taken along line 4-4.

Now referring to FIG. 4, the stand 40 further includes a plurality of fastening members 50 for selectively engaging the top member 41 and the base member 42 with each other. Such fastening members 50 may include conventional wing nuts or push pins, for example. The top base member 41 has a plurality of oppositely spaced slots 45 extending substantially vertically therealong and the plurality of fastening members 50 are adjustably positionable along the plurality of slots 45 to thereby adjust a height of the stand 40. This allows a user to selectively position the bottle 11 at a height that is convenient for refilling with water and eliminates the necessity of bending over when doing so.

Figure 5:
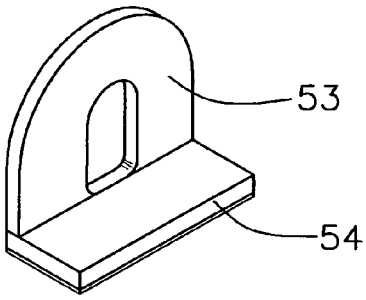
FIG. 5 is an enlarged perspective view of the guide member shown in FIG. 1.

Now referring to FIG. 5, the guide member 53 is shown as having an opening formed therein and extending upwardly from a base thereof. The guide member 53 is selectively attachable adjacent a tree base (not shown) via an adhesive layer 54 positioned at a bottom surface thereof. Advantageously, the guide member 53 receives tube 30 therethrough and maintains same at a substantially select position so that the tube does not get bumped off the tree base.

The apparatus 10 enables a user to water a Christmas tree without having to awkwardly reach through sharp pine needles, knock off fragile ornaments, or step on gift packages. Furthermore, water would not be spilled on packages, the floor, or the tree skirt. The apparatus 10 keeps the Christmas tree fresh and watered, reducing the potential for fires that originate in dry Christmas trees in an indoor, heated environment. In addition, fewer needles would fall off the branches, resulting in less time and energy being spent to clean up the fallen needles.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A Christmas tree water feeder comprising:

a bottle defining a reservoir and having an opening for allowing fluid to travel outwardly from said reservoir;

an elongated flexible hose defining a conduit and having a first end portion in fluid communication with the opening, said hose further having an oppositely spaced second end portion extending outwardly and away from said bottle;

an elongated rigid tube having a longitudinal axis and opposed end portions engageable with said second end portion of said hose and a basin housing a plant, one said opposed end portions of said tube having an arcuate shape and extending in a substantially orthogonal direction to the axis;

a stand for supporting said bottle thereon and at an inverted position, said stand including a top member and a base member adjustably engageable therewith and for allowing a height between the opening of said bottle and a ground surface to be selectively adjusted;

a plurality of fastening members for selectively engaging said top member and said base member with each other; and a guide member positionable adjacent a Christmas tree and having an opening formed therein for receiving said tube and for maintaining same at select positions;

wherein said top base member has a plurality of oppositely spaced slots extending substantially vertically therealong, said plurality of fastening members being adjustably positionable along said plurality of slots to thereby adjust a height of said stand.

2. The water feeder of claim 1, wherein said top member includes a substantially annular portion integral therewith and for receiving said bottle thereon.

3. The water feeder of claim 2, wherein said annular portion has an opening spaced above said base member and for allowing said tube to be selectively positioned therethrough.

4. The water feeder of claim 1, further comprising a rubber seal positioned adjacent said opening and being spaced from said first end portion of said hose, said rubber seal for assisting to prevent water from leaking out of said opening.

5. The water feeder of claim 1, further comprising a cap including a threaded inner surface for threadably engaging said opening, said cap having an aperture formed substantially centrally thereof and being in fluid communication with said flexible hose.

6. A Christmas tree water feeder comprising:

a bottle defining a reservoir and having an opening for allowing fluid to travel outwardly from said reservoir;

an elongated flexible hose defining a conduit and having a first end portion in fluid communication with the opening, said hose further having an oppositely spaced second end portion extending outwardly and away from said bottle;

an elongated rigid tube having a longitudinal axis and opposed end portions engageable with said second end portion of said hose and a basin housing a plant, one said opposed end portions of said tube having an arcuate shape and extending in a substantially orthogonal direction to the axis;

a stand for supporting said bottle thereon and at an inverted position, said stand including a top member and a base member adjustably engageable therewith and for allowing a height between the opening of said bottle and a ground surface to be selectively adjusted, said top member including a substantially annular portion integral therewith and for receiving said bottle thereon;

a plurality of fastening members for selectively engaging said top member and said base member with each other; and a guide member positionable adjacent a Christmas tree and having an opening formed therein for receiving said tube and for maintaining same at select positions;

wherein said top base member has a plurality of oppositely spaced slots extending substantially vertically therealong, said plurality of fastening members being adjustably positionable along said plurality of slots to thereby adjust a height of said stand.

7. The water feeder of claim 6, wherein said annular portion has an opening spaced above said base member and for allowing said tube to be selectively positioned therethrough.

8. The water feeder of claim 6, further comprising a rubber seal positioned adjacent said opening and being spaced from said first end portion of said hose, said rubber seal for assisting to prevent water from leaking out of said opening.

9. The water feeder of claim 6, further comprising a cap including a threaded inner surface for threadably engaging said opening, said cap having an aperture formed substantially centrally thereof and being in fluid communication with said flexible hose.

10. A Christmas tree water feeder comprising:

a bottle defining a reservoir and having an opening for allowing fluid to travel outwardly from said reservoir;

an elongated flexible hose defining a conduit and having a first end portion in fluid communication with the opening, said hose further having an oppositely spaced second end portion extending outwardly and away from said bottle;

an elongated rigid tube having a longitudinal axis and opposed end portions engageable with said second end portion of said hose and a basin housing a plant, one said opposed end portions of said tube having an arcuate shape and extending in a substantially orthogonal direction to the axis;

a stand for supporting said bottle thereon and at an inverted position, said stand including a top member and a base member adjustably engageable therewith and for allowing a height between the opening of said bottle and a ground surface to be selectively adjusted, said top member including a substantially annular portion integral therewith and for receiving said bottle thereon, said annular portion has an opening spaced above said base member and for allowing said tube to be selectively positioned therethrough;

a plurality of fastening members for selectively engaging said top member and said base member with each other; and a guide member positionable adjacent a Christmas tree and having an opening formed therein for receiving said tube and for maintaining same at select positions;

wherein said top base member has a plurality of oppositely spaced slots extending substantially vertically therealong, said plurality of fastening members being adjustable positionable along said plurality of slots to thereby adjust a height of said stand.

11. The water feeder of claim 10, further comprising a rubber seal positioned adjacent said opening and being spaced from said first end portion of said hose, said rubber seal for assisting to prevent water from leaking out of said opening.

12. The water feeder of claim 10, further comprising a cap including a threaded inner surface for threadably engaging said opening, said cap having an aperture formed substantially centrally thereof and being in fluid communication with said flexible hose.

* * * * *